United States Patent [19]

Margolis

[11] Patent Number: 4,498,199

[45] Date of Patent: Feb. 12, 1985

[54] MULTIPLE HEADED COSTUME

[75] Inventor: Mark D. Margolis, Bloomington, Minn.

[73] Assignee: Spearhead Industries, Inc., Minneapolis, Minn.

[21] Appl. No.: 491,620

[22] Filed: May 4, 1983

[51] Int. Cl.[3] ..... A41D 11/00

[52] U.S. Cl. ..... 2/69; 2/84; 2/80

[58] Field of Search ..... 2/84, 75, 80, 49 R, 2/50, 199, 206, 69, 69.5

[56] References Cited

U.S. PATENT DOCUMENTS

| | | | |
|---|---|---|---|
| D. 155,752 | 10/1949 | Vivaudou | 2/49 R X |
| 2,853,710 | 9/1958 | Swann | 2/75 X |
| 3,308,479 | 3/1967 | Sesco | 2/50 |
| 3,360,801 | 1/1968 | Parrilla | 2/199 |
| 3,523,302 | 8/1970 | Rabedeaux | 2/69.5 |
| 4,218,780 | 8/1980 | Growe et al. | 2/199 |

*Primary Examiner*—H. Hampton Hunter

*Attorney, Agent, or Firm*—James R. Cwayna

[57] ABSTRACT

A comic costume which includes at least a partial poncho-type element for covering at least selected postions of the person wearing the costume, with the poncho extending at least over the shoulders of the person, and a pair of inflatable members arranged respectively one on each shoulder of the poncho, with an opening for the head of the person wearing the costume arranged therebetween. The inflatable members consist of simulated heads which will stand in upright position on the person's shoulders when the same are inflated. The heads are caricatures or the like, and an additional headpiece is provided for the person wearing the costume, and the entire unit will include facial makeup materials, so that the person wearing the costume may decorate his or her face in the same manner that the heads are decorated, so that when the costume is properly worn, it will appear as though the person has three heads. In the particular form shown, both the front and rear surfaces of the inflatable costume heads are decorated in the same manner.

11 Claims, 5 Drawing Figures

MULTIPLE HEADED COSTUME

FIELD OF THE INVENTION

This invention relates generally to costumes, and more particularly to a costume which incorporates a body poncho or body covering element having an aperture for a person's head such that the body portion will rest upon the person's shoulders with a pair of inflatable, simulated heads respectively arranged one on each of the shoulder portions with an additional head covering being provid-d for the user's head, with means to attach the same to the person's head.

SHORT SUMMARY OF THE INVENTION

A costume which is designed to simulate a three-headed individual and which includes a body, poncho-type covering for the body of the user, with two inflatable heads arranged on what would be the shoulder portions of the body covering, with means to inflate the individual heads.

The costume kit includes a head covering for the head of the user, which is attachable to the head of the user, and the unit will also include facial makeup or facial decorating material, such that the person may decorate or make up his or her face in the same style the inflatable heads are made up, to thereby give the appearance of a three-headed individual. The unit is so structured that the heads will stand in generally upright position upon the shoulders of the wearer, so that the final effect will be and suggest a person having three heads.

The unit is formed of a vinyl-type material and, obviously, the heads must be air-retaining to permit their inflation. Further, in the form shown, both the front and rear surfaces of the inflatable heads are decorated.

BACKGROUND AND OBJECTS OF THE INVENTION

The applicant is well aware of various Hallowe'en or other festive costumes that are presently available. In his consideration of the prior art, he has discovered various mask portions and various head covering portions which are inflatable. Such prior art includes patents to Parilla, U.S. Pat. No. 3,360,801; Growe, U.S. Pat. No. 4,218,780; Sterrick, U.S. Pat. No. 885,802, and Rikelman, U.S. Pat. No. 2,593,188. These prior art patents are directed to units which incorporate at least a portion thereof which is inflatable and of this prior art, the patent to Growe is probably the most pertinent, in that it is related to an entire head or facial construction which incorporates or may incorporate a facial unit. The Growe patent, however, is designed with a cap structure for attachment and placement upon the top of a person's head.

None of these prior art patents relate to a unit which includes at least one inflatable head which is attached to or mounted on a body portion, which body portion is worn by the user, thereby allowing the inflated head to be arranged and positioned next to the head of the user to simulate a multiple-headed figure.

With the applicant's device, a body structure such as a poncho-type member is provided wherein an aperture is provided to permit the head of the user to extend therethrough, and the remaining body portion includes shoulder portions upon which the inflatable heads are postitioned, such that after inflation, the heads of the costume are positioned next to the head of the user, to simulate a three-headed person.

An aspect of this invention which should be considered is a safety function, in that the unit does not include a face covering mask, which could prevent the user from proper vision, and another safety factor is the concept of two heads adjacent the user's head, and undoubtedly these two heads will move when the person is walking, to provide an attention-attracting unit.

It is therefore an object of the applicant's invention to provide a costume which includes a means for providing at least one inflatable head which will be postitioned in side-by-side relationship to the head of the user to simulate a multiple-headed figure.

It is a further object of the applicant's invention to provide a costume having a body-covering section which will cover the shoulders of the wearer or user, and having at least one inflatable head on each of the shoulder portions, such that when the heads are inflated, a three-headed figure is simulated.

It is still a further object of the applicant's invention to provide a costume including a body covering portion having an aperture for passage of the user's head therethrough, with the remaining body portion rested and supported on the shoulders of the person, with an inflatable, simulated head on each of the shoulder portions with the front and rear portions of the simulated heads being decorated.

It is still a further object of the applicant's invention to provide a comic costume which includes a body, poncho-type unit for draping over the body of the user, with an aperture for the user's head and including thereby, shoulder covering elements, which shoulder covering elements are provided with inflatable, simulated head structures and the costume including at least a head covering for the person with decorative materials for making up or coloring the person's face in accordance with the selected costume design for the simulated heads, such that the final result will be a multiple, in this case, three-headed figure.

These and other objects and advantages of the applicant's costume will become more apparent from a consideration of the accompanying description of a preferred form of the invention, made in connection with the accompanying drawings, in which the same number, numeral or indicia is utilized to identify the same or similar parts throughout the several views.

DESCRIPTION OF A PREFERRED FORM OF THE INVENTION

Figure 1:
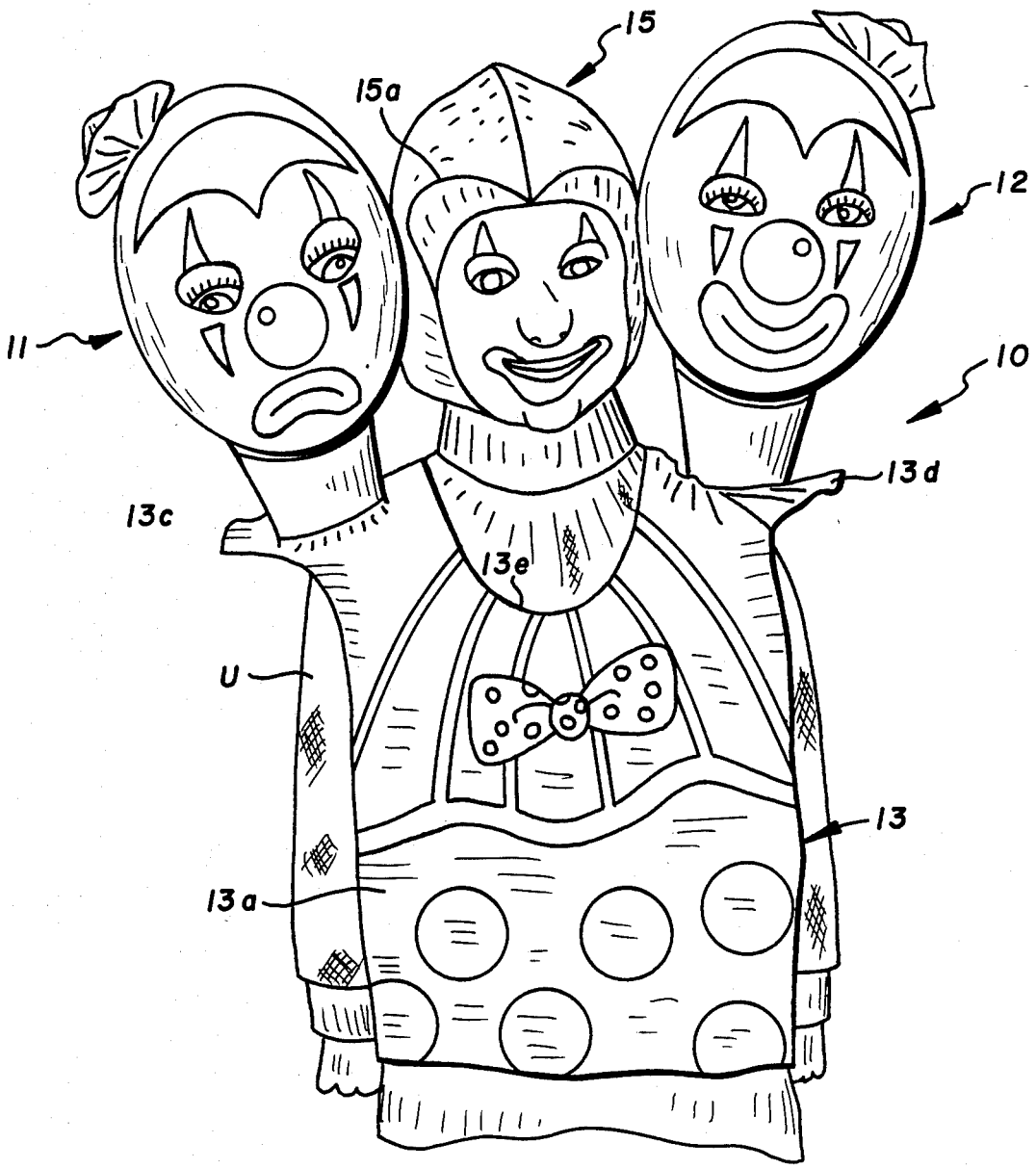
FIG. 1 is an artist's concept of the front view of the invention as the same would appear on the body of a user, and illustrating the two simulated heads of the costume in inflated condition with the user's head being made up in accompanying decorative features to that of the simulated heads.
Figure 3:
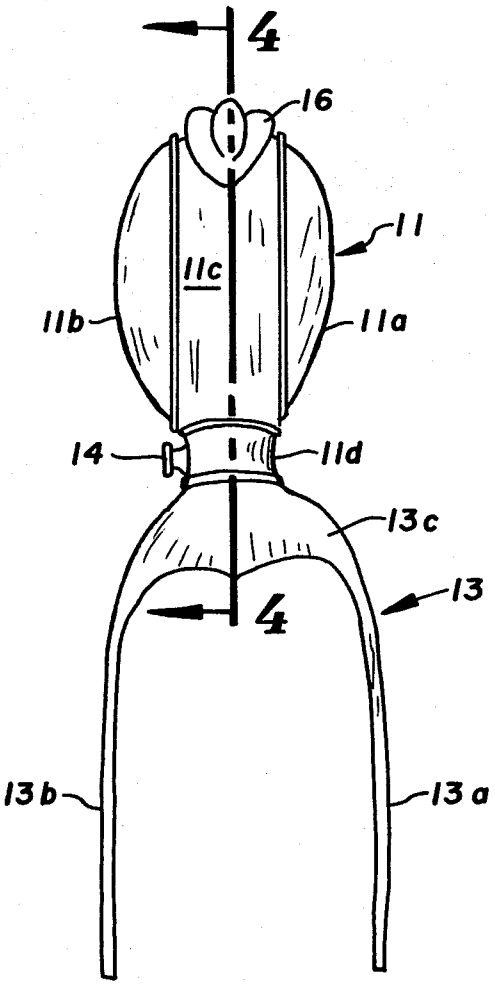
FIG. 3 is a side elevation taken from FIG. 2.

In accordance with the accompanying drawings, the applicant's unit, designed to give the appearance of a multi-headed figure, is designated generally 10 and its usage upon a person is particularly illustrated in FIG. 1. As illustrated therein, the unit 10 is properly positioned upon a user, U, with the inflated head portions 11, 12 being positioned on the body shroud or poncho 13 such that the heads 11, 12 will be in position upon the shoulders of the user and, thus, when they are inflated, will stand upright in side-by-side relation to the user's head. To complete the costume, a head covering 15 is provided for the user, and the particular shape of the head covering 15 is correlated to give, at least, an initial coordinated, decorated shape to the user's head.

The entire costume will include decorative materials by which the user, U, will decorate his or her face to correlate with the faces provided on the two inflated heads 11, 12.

In the form shown, the body portion 13 includes a front panel 13*a* and a back panel 13*b* which panels are continuously joined through a shoulder or base section to thereby provide two shoulders or bases 13*c*, 13*d* with a head passing aperture 13*e* provided therebetween. As illustrated, the shoulder or base portions 13*c*, 13*d* may extend slightly outwardly from the normal outer line of the body portion 13 to provide a sufficiently large mounting section for mounting of the heads 11, 12 thereon. Obviously, in usage, it is most desirable that these head structures 11, 12 be in generally upright position such that they will be positioned on either side of the user's head to provide the effect of a multiple headed person.

Figure 2:
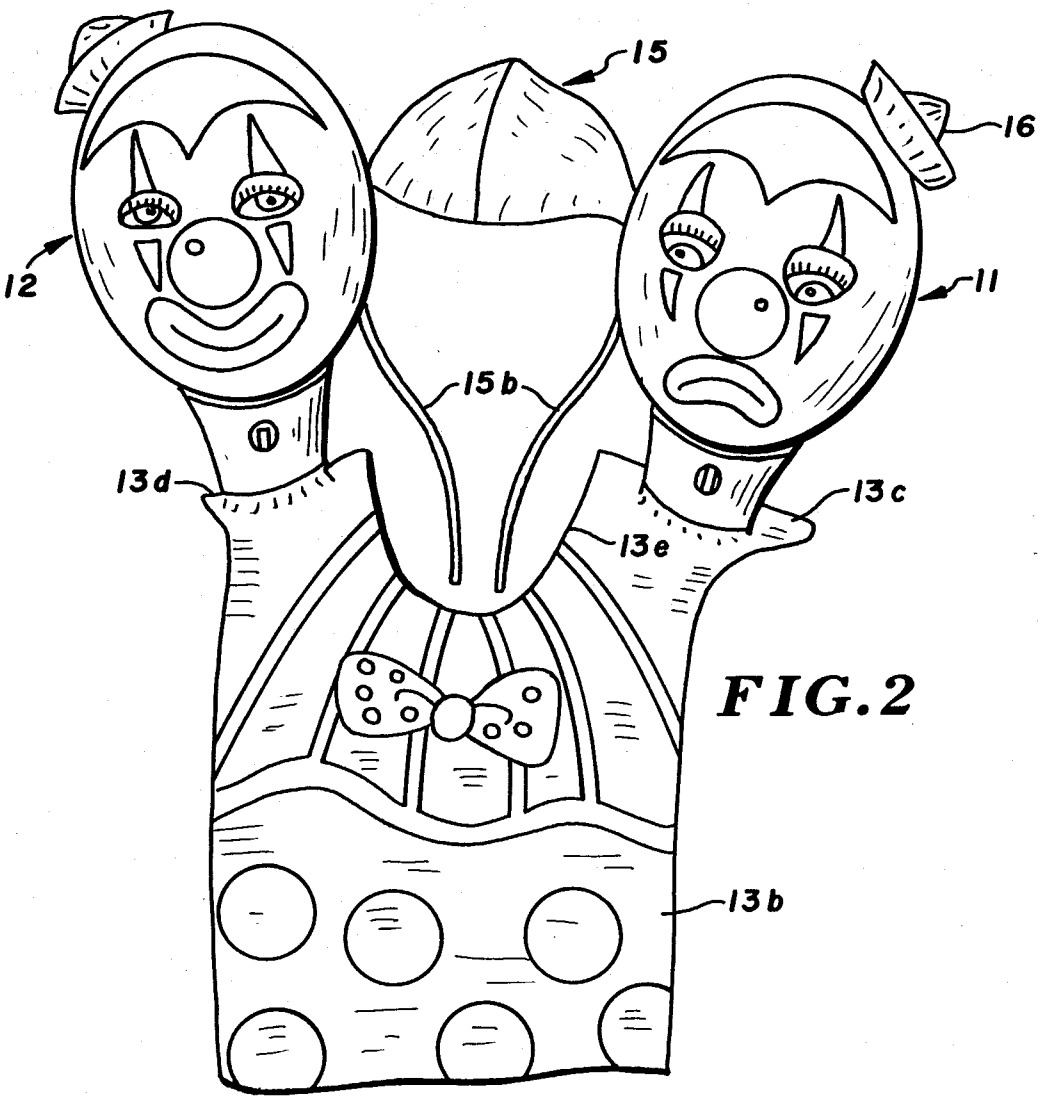
FIG. 2 is a rear view illustrating the unit as shown in FIG. 1.

As illustrated, the front and rear panels 13*a*, 13*b* of the body portion 13 may be decorated in any desired manner and also, as illustrated in FIGS. 1 and 2, the decorating of these front and rear panels 13*a*, 13*b* and the heads 11, 12 may be provided such that the same effect and appearance is obtained from either the front or the back of the person.

Figure 4:
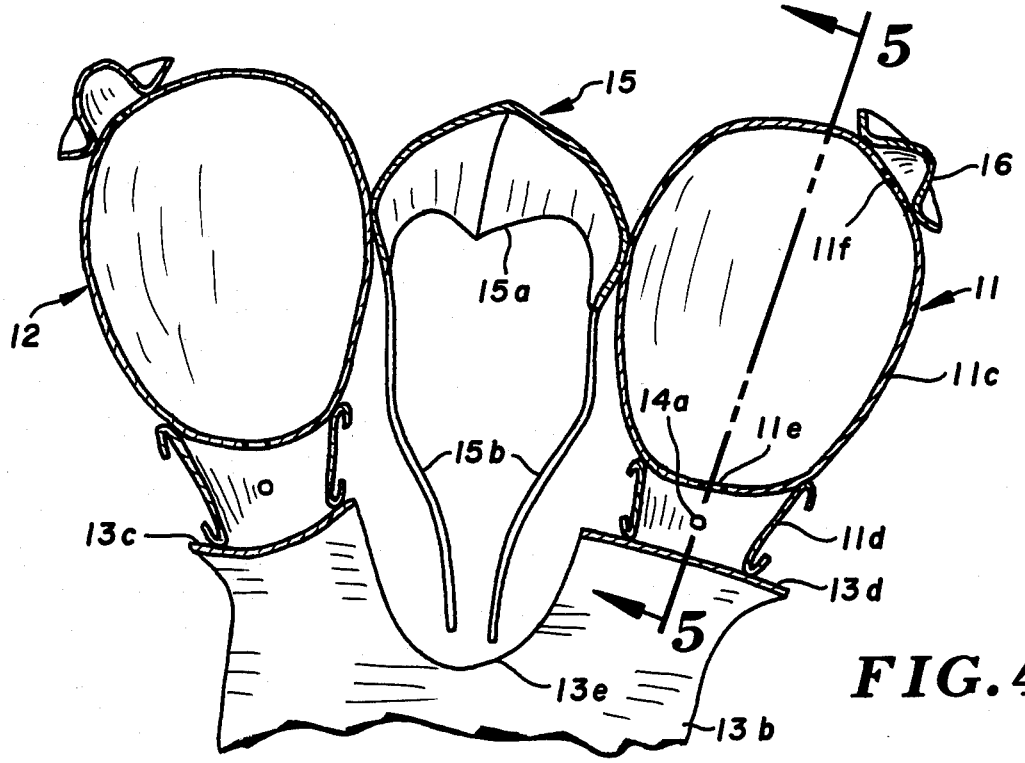
FIG. 4 is a vertical section taken substantially along Line 4—4 of FIG. 3; and, FIG. 5 is a section taken substantially along Line 5—5 of FIG. 4.
Figure 5:
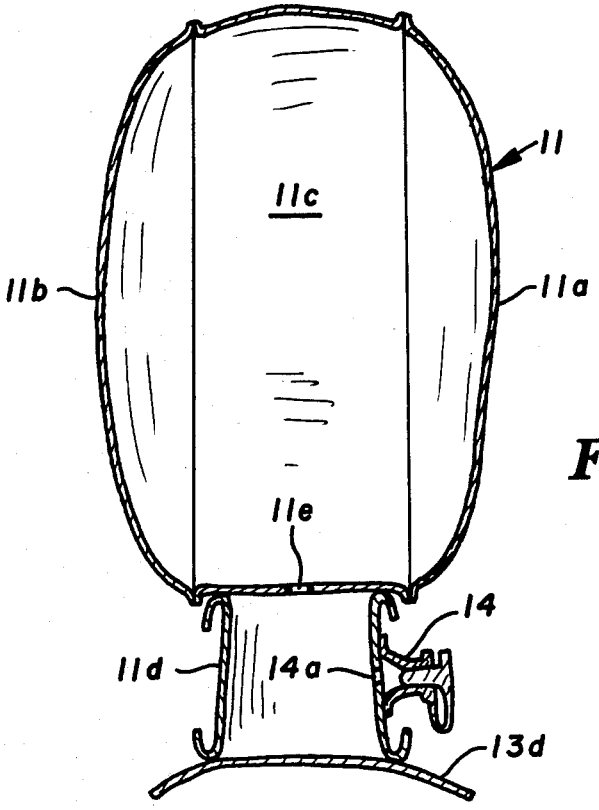

The structure for the individual heads 11, 12 is particularly illustrated in FIGS. 4 and 5. It should be obvious that many other forms of construction for the heads may be utilized without departing from the scope of the invention.

As best illustrated in FIG. 5, a typical head includes a front panel 11*a*, a rear panel 11*b* and a generally cylindrical central portion 11*c*, the front panel and rear panel being sealingly joined to the central portion. The head 11 also includes a neck portion 11*d*, sealingly attached to said central portion 11*c* and to a respective shoulder portion, in this illustration, 13*d*. An inflation valve, many of which are known to the art, is illustrated on the neck portion 11*d* and such valve is designated 14. Obviously, apertures such as 14*a* and 11*e* must be provided for permitting the flow of air into the head unit.

A particular head configuration, shown in the drawings, includes a further inflatable appurtenance such as a hat or other similar article, the same being designated 16. Such appurtenance may be inflated through an aperture 11*f* connecting the same to the head structure. Such an addition is purely a matter of choice, as is the selected structure of the head which incorporates the front and rear panels and central portion. The applicant could have provided a simple balloon-type structure for the head simulation but, with the unit illustrated, a relatively flat front and rear panel are provided for ease of decorating.

The entire costume also includes the user's helmet or head covering 15. This head covering 15 is provided as a decorative element and, as particularly illustrated in FIGS. 1 and 4, the frontal portion of the head covering 15 may be provided with a peak or similar matching frontal formation 15*a* which will match the design on the faces of the inflated heads 11, 12. Tie structures 15*b* are provided to secure the helmet 15 to the user's head.

As stated in the objects of the application, the entire kit will contain decorative makeup materials such that the user may make up his or her face in a manner corresponding to the faces of the inflated heads.

The ultimate use of the invention should be obvious. The concept of "Clones" and "Cloning" is well known and, with the unit shown, a person can be and provide their own clone.

Advantages of the unit have been stated and these include the safety element which becomes extremely important for childred when going out for night occasions such as Halloween.

It should be obvious that the applicant has provided a new and unique costume for a multi-headed effect.

What is claimed is:

1. A costume unit to provide the effect of a multi-headed figure when worn on a person, such costume unit including:

a. an inflatable member arranged and constructed to simulate a head;

b. means for inflating said head member;

c. a base portion arranged and constructed for placement and positioning on the shoulders of the person using the costume; and, d. said inflatable, simulated head being secured to said base portion whereby said head is positioned in side-by-side relation to the head of the user.

2. The costume unit set forth in claim 1 and said base portion extending to cover both shoulders of the user and an inflatable head member arranged on each of the outstanding portions of said base portion to provide, when worn, a pair of simulated heads, one on each side of the user's head.

3. The costume unit set forth in claim 2 and an aperture provided through said base portion to allow the same to be placed over the user's head.

4. The costume unit set forth in claim 3 and said base portion including at least a first, downwardly extending panel to cover a portion of the user's body.

5. The costume unit set forth in claim 4 and said base portion including a second, downwardly extending panel, whereby one of said panels covers the front of the user's body, said other panel covering the back of the user's body.

6. The costume unit set forth in claim 1 and said simulated head including a neck portion.

7. The costume unit set forth in claim 6 and said inflating means being arranged in said neck portion, said head and neck allowing communication of inflating air.

8. The costume unit set forth in claim 1 and said simulated head including a front panel, a rear panel and a generally cylindrical central portion, said panels and said central portion being sealingly connected.

9. The costume unit set forth in claim 8 and a decorative face being applied to at least one of said panels of said simulated head.

10. The costume unit set forth in claim 9 and a decorative face being applied to both of said front and rear panels of said simulated head.

11. The costume unit set forth in claim 1 and a head covering having means to secure the same to and to cover at least a selected portion of the user's head.

* * * * *